US007143588B2

(12) United States Patent
Cole

(10) Patent No.: US 7,143,588 B2
(45) Date of Patent: Dec. 5, 2006

(54) SYSTEM AND METHOD FOR CONTROLLING ICE TRAY FILL IN AN ICE MAKER

(75) Inventor: Ronald E. Cole, Greenwood, IN (US)

(73) Assignee: Emerson Electric Co., St. Louis, MO (US)

( * ) Notice: Subject to any disclaimer, the term of this patent is extended or adjusted under 35 U.S.C. 154(b) by 136 days.

(21) Appl. No.: 11/079,583

(22) Filed: Mar. 14, 2005

(65) Prior Publication Data

US 2006/0201170 A1 Sep. 14, 2006

(51) Int. Cl.
*F25C 1/04* (2006.01)

(52) U.S. Cl. ..... 62/74; 62/347

(58) Field of Classification Search ..... 62/74, 62/347, 71, 73, 351, 353; 249/119
See application file for complete search history.

(56) References Cited

U.S. PATENT DOCUMENTS 4,142,378 A 3/1979 Bright et al.
4,774,814 A 10/1988 Yingst et al.
4,843,830 A 7/1989 Haul
4,852,359 A * 8/1989 Manzotti ..... 62/68
4,852,621 A 8/1989 Bear
5,056,322 A * 10/1991 Patrick ..... 62/73
5,165,255 A 11/1992 Alvarez et al.
5,212,955 A * 5/1993 Hogan ..... 62/73
5,408,844 A 4/1995 Stokes
5,460,007 A 10/1995 Reed et al.
5,655,561 A 8/1997 Wendel et al.
6,052,841 A 4/2000 Mankin et al.
6,282,909 B1 * 9/2001 Newman et al. ..... 62/74
6,311,503 B1 11/2001 Shapiro et al.
6,438,976 B1 8/2002 Shapiro et al.
6,460,367 B1 10/2002 DuHack
7,013,654 B1 * 3/2006 Tremblay et al. ..... 62/73

* cited by examiner

*Primary Examiner*—William E. Tapolcai
(74) *Attorney, Agent, or Firm*—Maginot Moore and Beck

(57) ABSTRACT

A water control system for an ice maker includes a capacitive sensor located within a compartment of an ice tray in an ice maker. The capacitive sensor generates a water fill signal corresponding to dielectric changes in the sensor as water fills the compartment of the ice tray. A controller coupled to the sensor generates a water valve control signal in response to the water fill signal received from the capacitive sensor. The controller may initiate a water fill cycle and then close the water valve in response to the water fill signal indicating a change in dielectric caused by the rising water reaching an electrode of the capacitive sensor. Thus, the system of the present invention enables the controller to accurately control the flow of water into the ice tray without reference to a predetermined fill time.

16 Claims, 14 Drawing Sheets

SYSTEM AND METHOD FOR CONTROLLING ICE TRAY FILL IN AN ICE MAKER

CROSS REFERENCE

Cross reference is made to co-pending U.S. patent application Ser. No. 10/895,665 filed Jul. 21, 2004, entitled Method and Device for Stirring Water During Icemaking, U.S. patent application Ser. No. 10/895,792 filed Jul. 21, 2004, entitled Method and Device for Eliminating Connecting Webs Between Ice Cubes, U.S. patent application Ser. No. 10/895,570 filed Jul. 21, 2004, entitled Method and Device for Producing Ice Having a Harvest-facilitating Shape, all of which are assigned to the same assignee as the present invention, the disclosures of which are expressly incorporated by reference in their entirety.

FIELD OF THE INVENTION

This invention relates to icemakers for household refrigerators and, more particularly, to water fill control systems for such ice makers.

BACKGROUND OF THE INVENTION

Conventional ice makers typically provide an ice tray including a plurality of compartments that are filled with water and frozen to form ice cubes. A water supply is typically in fluid communication with at least one of the compartments of the ice tray. Often weirs, slots or gaps are provided between adjacent compartments in the tray so that water flows from a filled compartment into an adjacent compartment to fill the ice tray.

Typically, ice makers use a timer controlled valve on the water supply to determine the level of water in the compartments. This method of controlling water level suffers from a number of limitations. For one, the flow rates of household water supplies vary in response to load changes. For example, toilet flushes and lawn watering can substantially affect water flow rate in a house. Additionally, flow rates may change over time as mineral deposits in water and collect in the pipes restricting the water flow. The fluctuations in flow rates for a house mean that the amount of water filling an ice tray may significantly vary from cycle to cycle despite the accurate measurement of a fill time period. These variations affect the quantity of ice produced by an ice maker.

Problems with accurate water fills also affect the quality of the ice harvested. In many ice makers, a temperature sensor is placed in one compartment of the ice tray and the ice is harvested upon the sensed temperature in that compartment reaching a predetermined temperature that corresponds to the water in the compartment being adequately frozen. If the compartment in which the temperature sensor is located is only partially filled, then the ice harvest cycle may be initiated before the water has adequately frozen in the other ice tray compartments. This unequal filling of ice tray compartments may be caused by a floor settling so that the ice tray is tilted and no longer level. Ice harvests initiated upon detection of a predetermined temperature in a partially filled compartment results in the formation of ice having watery centers in the other compartments. This type of ice may break during the ice harvest and leave water in the compartments after the harvest. The water remaining in the compartments after ice harvest may cause compartment overfilling on the next fill cycle. If ice with a watery center does not break during the harvest cycle, it may break upon impact in the ice bin where the harvested ice is collected. Partially frozen ice breaking in the ice bin releases water that flows between other ice pieces and freezes them together. This may cause the ice to jam in the chute of an ice dispenser or to lump into a configuration that does not easily fit in a glass.

These problems make the accurate filling of the ice tray compartment in which the temperature sensor is located an important aspect of ice formation and harvesting.

SUMMARY OF THE INVENTION

Additional features and advantages of the present invention will become apparent to those skilled in the art upon consideration of the following detailed description of preferred embodiments exemplifying the best mode of carrying out the invention as presently perceived.

In accordance with the principles of the present invention, a water control system for an ice maker includes a capacitive sensor located within a compartment of an ice tray in an ice maker. The capacitive sensor generates a water fill signal corresponding to dielectric changes in the sensor as water fills the compartment of the ice tray. A controller coupled to the sensor generates a water valve control signal in response to the water fill signal received from the capacitive sensor. The controller may initiate a water fill cycle and then close the water valve in response to the water fill signal indicating a change in dielectric caused by the rising water reaching an electrode of the capacitive sensor. Thus, the system of the present invention enables the controller to accurately control the flow of water into the ice tray without reference to a predetermined fill time.

The capacitive sensor may housed in a semi-cylindrical housing that frictionally fits within a fill level reservoir in the ice tray. The housing is formed from electrically insulating material. The housing has two openings in which two electrodes are mounted so they are electrically isolated from one another and from the ice tray. The electrodes are exposed to water filling the compartment in the ice tray. The electrodes are electrically coupled by wires to the controller to provide the water fill signal.

The electrodes form the plates of a capacitor. The two electrodes are preferably arranged in a substantially vertical configuration with reference to a top and a bottom of the compartment so that water filling the compartment submerges one electrode before contacting the second electrode. When the dielectric between the plates is air, as when the compartment is empty, the capacitance of the sensor is a smaller value than when the lower electrode contacts water filling the compartment. Because water has a dielectric value that is approximately eighty (80) times greater than air, the capacitance of the sensor significantly increases when water contacts the lower electrode. This increase results in a change in the water fill signal generated by the sensor that indicates to the controller the water level has reached the lower electrode in the compartment. If the water continues to rise in the compartment to the place where water contacts the upper electrode, the water electrically couples the electrodes to one another.

In response to the capacitive sensor indicating an increase in the dielectric of the sensor, the controller generates a water valve control signal that shuts the water fill valve to terminate water flow into the compartment. Residual water in the fill line and spout continues to flow into the compartment, but no further flow from the water supply occurs. The controller includes a timer for timing a period from the controller generating a water valve control signal that opens the water valve to the controller receiving a signal from the capacitive sensor that indicates an increase in the dielectric of the capacitive sensor. A flow rate meter in the controller measures a flow rate of water filling the compartment with reference to the timed period. The flow meter may be implemented in software executed by the controller. The software uses a volumetric parameter that corresponds to the volume of the preceding compartments that were filled before the compartment in which the sensor is placed was filled plus the volume formed by a line around the inside perimeter of the compartment at the lower electrode to the bottom of the compartment. This volumetric parameter is divided by the time period measured from the opening of the water valve to the change in the water fill signal generated by the sensor in response to the rising water to determine the water flow rate.

The controller also includes a dielectric differential rate meter for measuring a rate of change in the water fill signal received from the capacitive sensor. The change in this signal corresponds to the displacement of the air between the electrodes by the water rising between the electrodes. A water hardness meter implemented in the controller measures the mineral hardness of the water filling the compartment. The water hardness meter is implemented in software and uses the measured flow rate and the dielectric differential rate to determine the mineral hardness.

The capacitive sensor may be placed in the control circuit for the water valve so that it shunts the water valve control signal in response to water in the compartment contacting both electrodes in the compartment. If a solenoid-controlled valve is used to control water flow into the ice tray and the capacitive sensor is electrically coupled across the solenoid-controlled valve, the sensor may be used as a backup control device for shutting off water flow to the ice tray. As noted above, water contacting both electrodes electrically couples the electrodes together. If the water valve control signal is coupled to the sensor, the signal is shunted to ground when water contacts both electrodes rather than flowing through the relay to energize the valve opening. By shunting the current through the shorted sensor, the water valve is shut off without requiring a control action by the controller. Thus, this electrical arrangement provides a backup to the regulation of the water fill valve by the controller.

A method for controlling water flow into an ice maker includes generating a water fill signal corresponding to a dielectric change in a capacitive sensor located in a compartment of an ice tray and generating a water valve control signal for opening and closing a water valve in response to the water fill signal. The water fill signal generation includes electrically isolating two electrodes from one another and the ice tray so the two electrodes are exposed to water filling the compartment. The water fill signal generated by the two electrodes corresponds to the dielectric change that results from water filling the compartment contacting the electrodes. The electrodes are preferably arranged so they are substantially aligned vertically with reference to a top and a bottom of the compartment. The dielectric increase signal generated by the electrodes so arranged is in response to the submersion of the electrode that is lower than the other electrode. The method of the present invention also includes generating a water valve control signal that shuts the water fill valve in response to the dielectric increase signal.

The method of the present invention may also compute process parameters from data obtained from the sensor. To obtain water flow, a period is timed from the commencement of water flowing into the ice tray until the generation of the dielectric increase signal. This time period and the volume of the water delivered to the ice tray may be used to measure a flow rate during the timed period. A mineral hardness parameter may also be determined by measuring a rate of change in the dielectric increase signal. The mineral hardness of the water filling the ice tray may be computed using the measured flow rate and the rate of change in the dielectric increase signal.

Backup control for the water valve is provided by shunting the water valve control signal to electrical ground in response to water in the compartment contacting both electrodes in the compartment. When a water valve control signal is coupled to a solenoid-controlled valve to control water flow into the ice tray, shunting the water valve control signal through the two electrodes to close the water valve in response to the water coupling the two electrodes together provides a backup control that helps prevent water overflow in the ice tray.

BRIEF DESCRIPTION OF THE DRAWINGS

The illustrative devices will be described hereinafter with reference to the attached drawings which are given as non-limiting examples only, in which.

Corresponding reference characters indicate corresponding parts throughout the several views. Like reference characters tend to indicate like parts throughout the several views.

DETAILED DESCRIPTION

Figure 1:
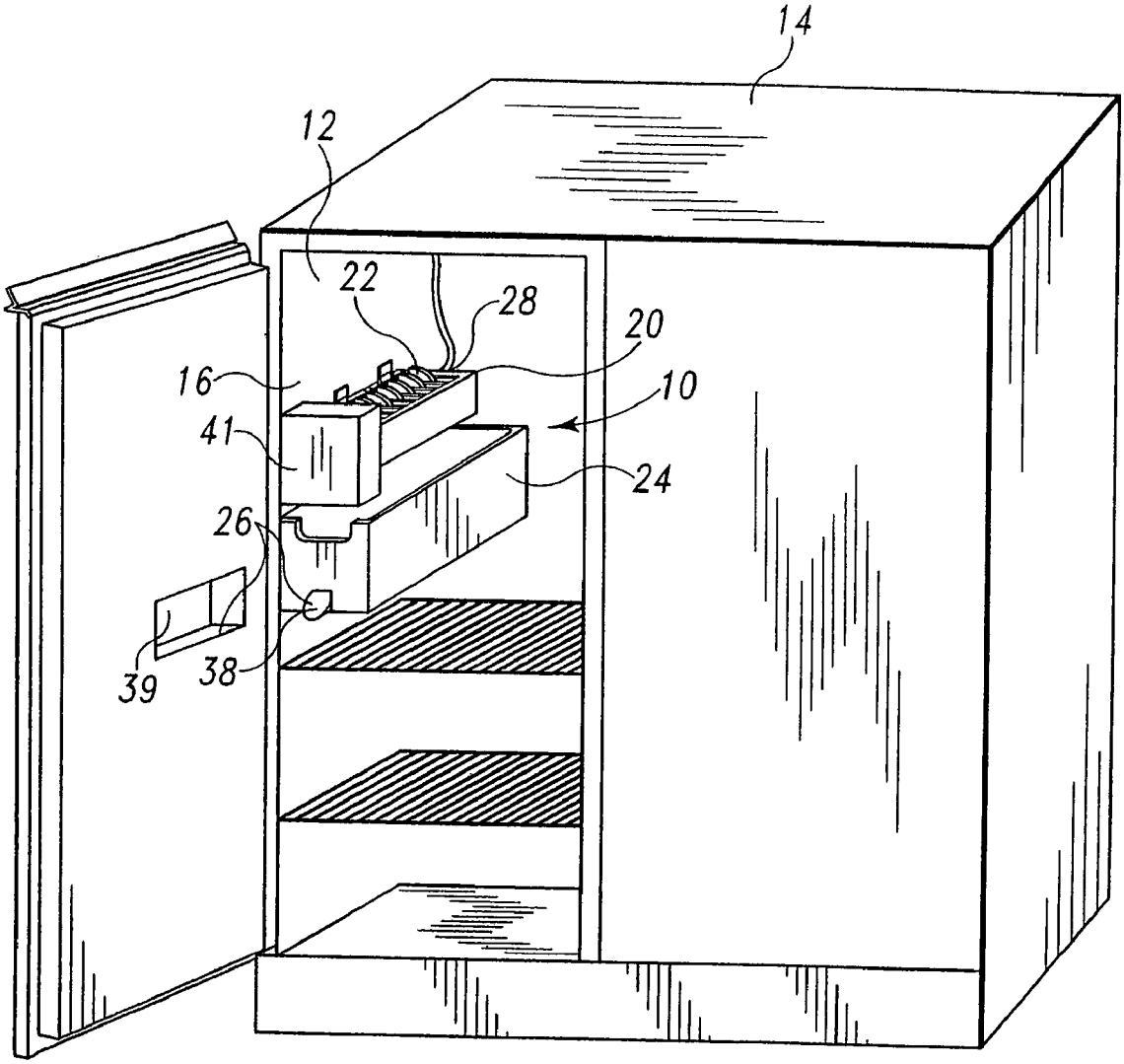
FIG. 1 is a perspective view of an icemaker mounted to the inside of a freezer compartment of a household side-by-side refrigerator/freezer showing an icemaker assembly including an ice tray, an ejector arm and a control box wherein a motor is mounted, a water inlet, and an ice bin.

For the purposes of promoting an understanding of the principles of the invention, reference will now be made to the embodiments illustrated in the drawings and described in the following written specification. No limitation to the scope of the invention is intended by the illustrated embodiments and the written specification. The reader should understand that the present invention includes any alterations and modifications to the illustrated embodiments and includes further applications of the principles of the invention as would normally occur to one skilled in the art to which this invention pertains.

As shown in FIG. 1, for example, an ice maker assembly 10 is incorporated in a freezer compartment 12 of a household side by side refrigerator/freezer 14. The icemaker assembly 10 is mounted to a side wall 16 of the freezer compartment 12. The illustrated refrigerator/freezer 14 includes delivery of ice and water through the door. To facilitate delivery of ice through the door, the illustrated ice maker assembly 10 includes an ice bin 24, an ice dispenser 26, a dispenser opening 38, and a chute 39. In the illustrated ice maker assembly 10, the water inlet or line 28 is in fluid communication between an ice tray 20 and a household water supply so that water may flow into the ice tray 20. A solenoid actuated water valve is disposed in the line 28 between the inlet 28 and the tray 20 to control the flow of water into the tray 20. Water received in tray 20 freezes and is removed from tray 20 by an ice ejector 22. Ice ejected from tray 20 is received in bin 24 where it is stored while awaiting use. The bin 24 is formed to include a dispenser 26 that includes a dispenser opening 38 through which ice is delivered and dispensed by chute 39 to the user. In the illustrated embodiment of ice maker assembly 10, dispenser 26 is a through the door ice dispenser.

Referring now to FIGS. 2–7, the icemaker assembly 10 is shown removed from the freezer compartment 12 and in various states of disassembly. In the illustrated embodiment, ice tray 20 includes a plurality of compartments 66 within which ice is formed. A first compartment **66*r* is positioned adjacent to the outlet of the water line 28 and is in fluid communication with the outlet. The illustrated tray 20 is designed for overflow filling, i.e., water fills the rear compartment 66*r* to the point of overflowing and the overflow water then fills the adjacent compartment 66**.

Figure 3:
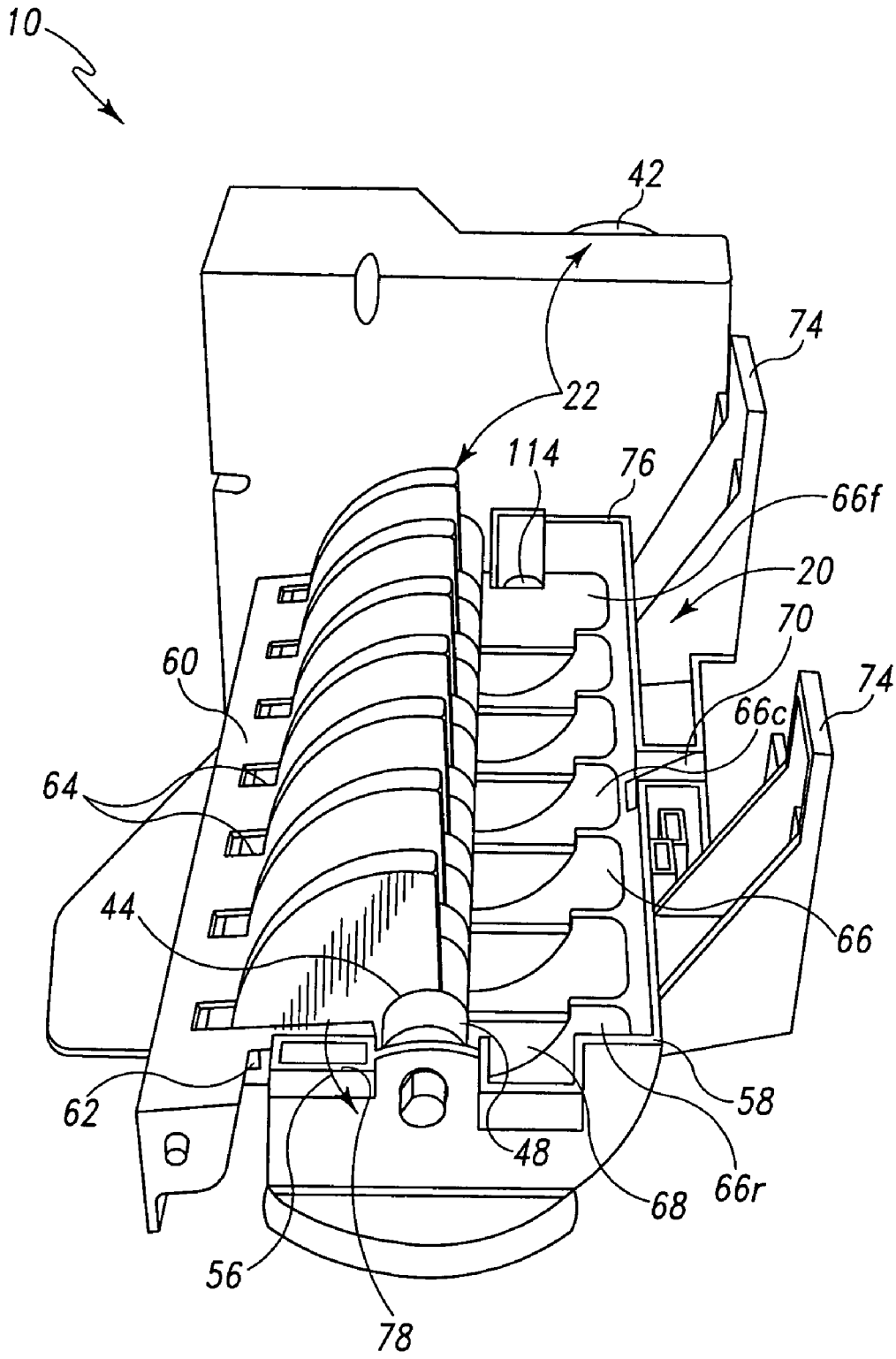
FIG. 3 is a perspective view of the ice tray and ejector arm of the icemaker of FIG. 2.
Figure 4:
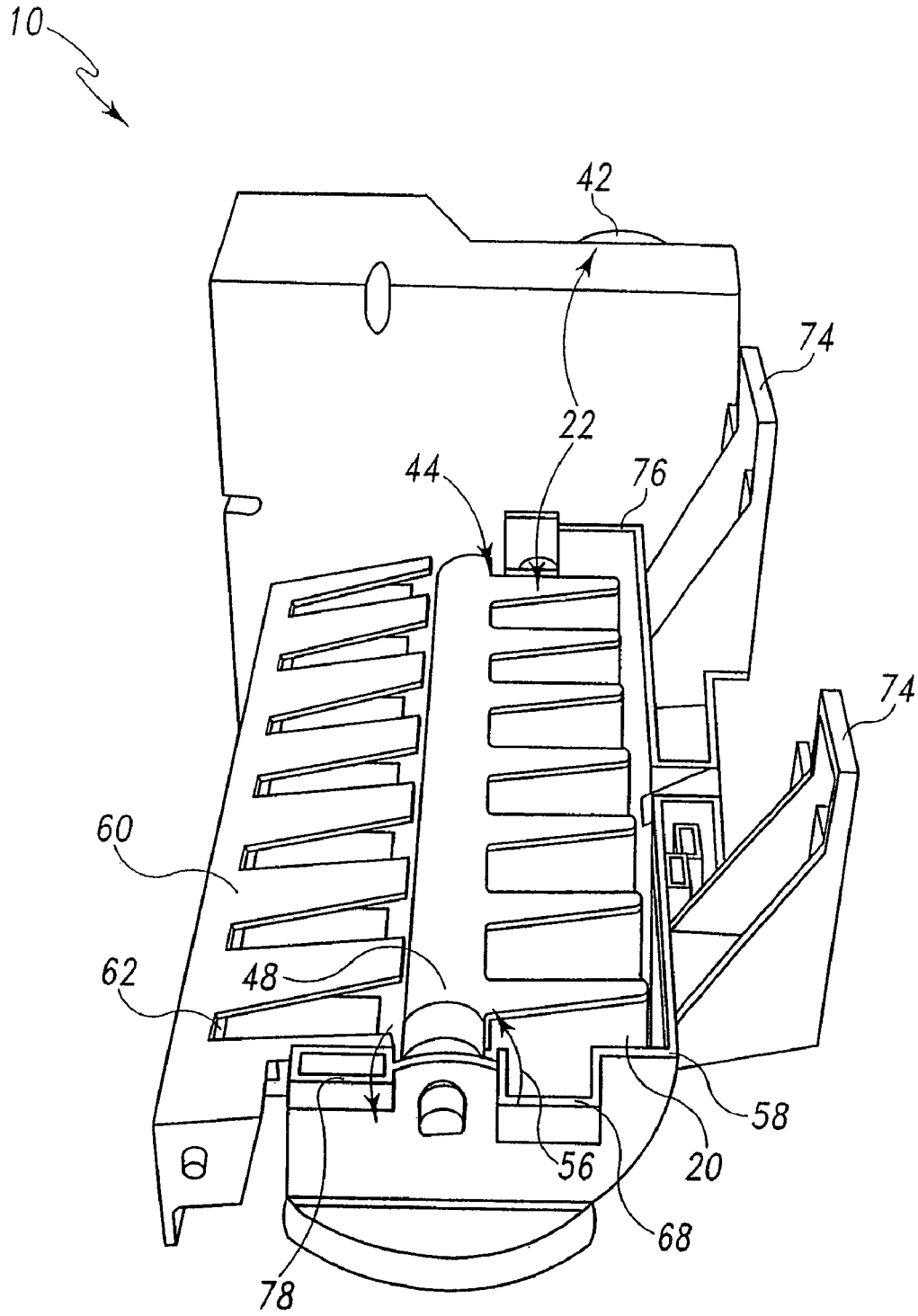
FIG. 4 is a perspective view of the ice tray and the ejector arm of the ice maker in a first position wherein displacement members mounted to the shaft of the ejector arm are disposed within the ice forming compartments of the ice tray.

As shown in FIG. 3, for example, ice tray 20 is formed to include seven tapered crescent-shaped compartments 66, an end water inlet ramp 68, a side water inlet ramp 70, and mounting brackets 74. Tray 20 includes a first end wall 76, a second end wall 78, a plurality of partitions or divider walls 80 and a plurality of floor walls 82 that cooperate to form the ice forming compartments 66. In the illustrated embodiment, as shown in FIG. 3, the end water inlet ramp 68 is formed in the second end wall 78 to be positioned below the water inlet to facilitate filling the seven compartments 66 using the overflow method. The side water inlet ramp 70 is provided for those refrigerator/freezers 14 that position the water inlet along the mounting wall 16 of the freezer compartment 12. Water inlet ramps communicating with an ice forming compartment 66 may be formed in other locations on the tray within the scope of the disclosure.

Figure 6:
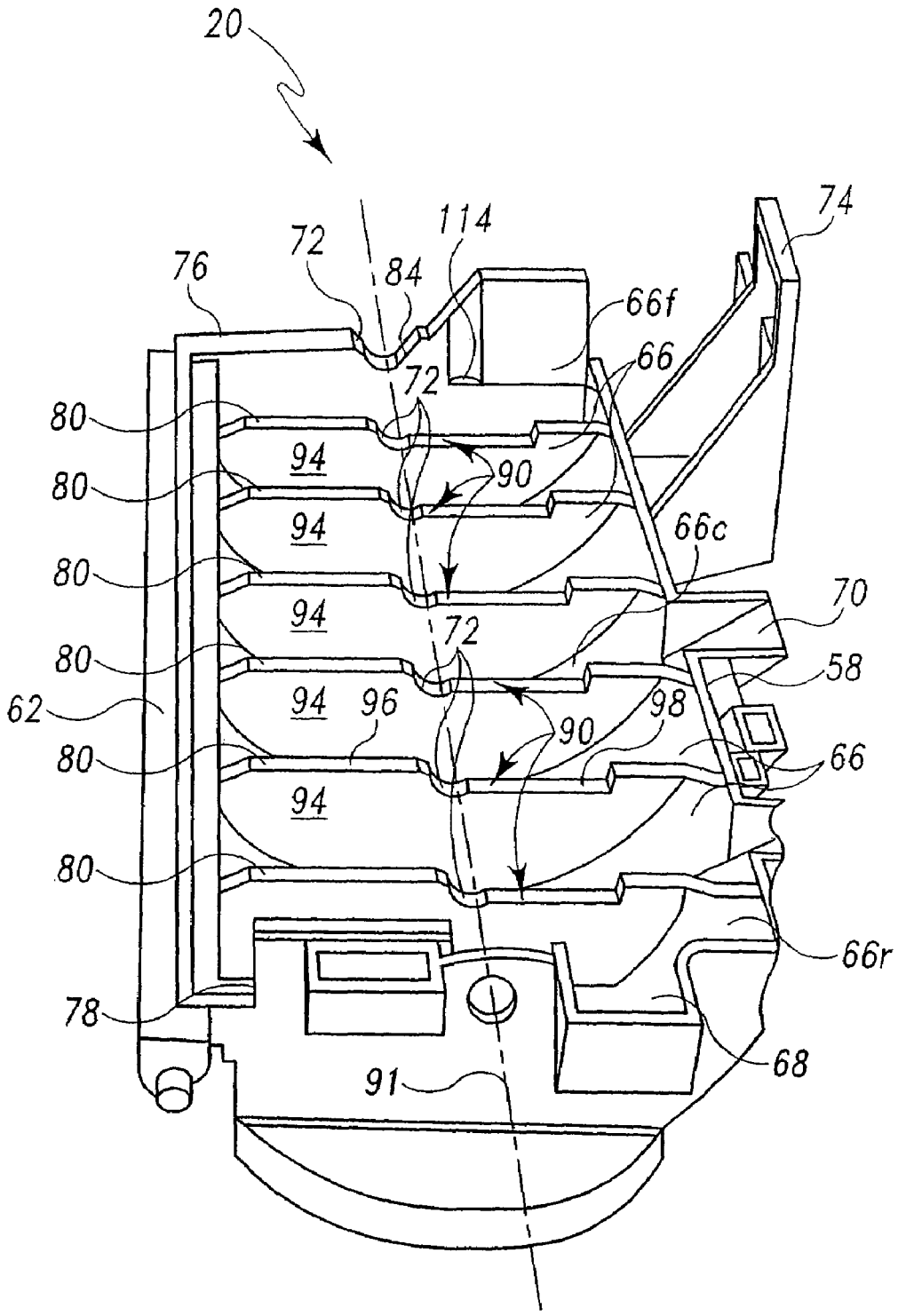
FIG. 6 is a perspective view of the ice tray of the icemaker assembly of FIG. 2 showing the overflow channels in divider walls between each adjacent crescent-shaped compartment that facilitate overflow filling of the ice tray.
Figure 7:
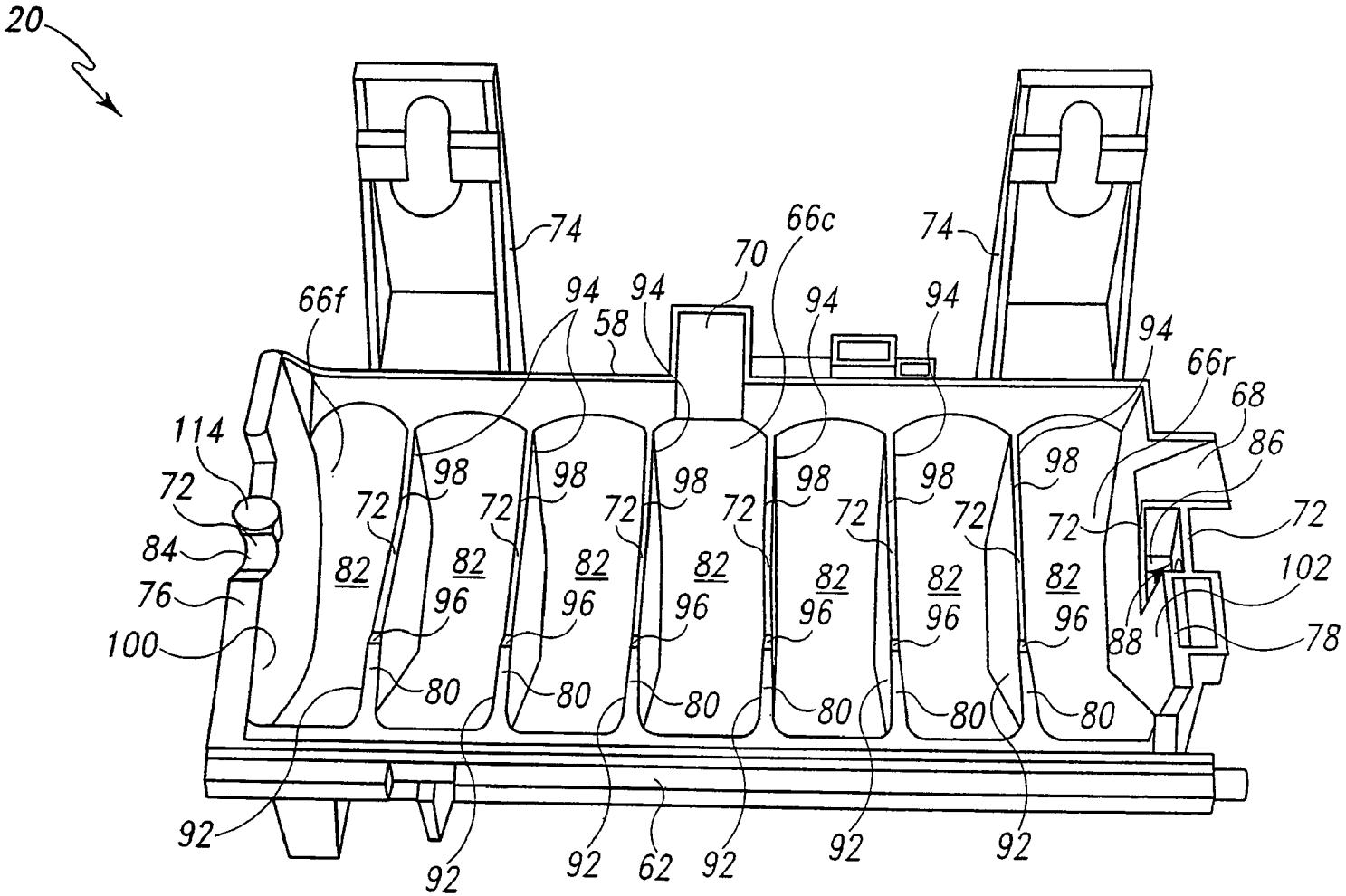
FIG. 7 is a perspective view of the ice tray of FIG. 6 showing the configuration of the divider walls between adjacent crescent-shaped compartments.

As shown in FIG. 6, the ejector mounting arm features 72 include a shaft-receiving semi-cylindrical bearing surface 84 formed in the first end wall 76, a shaft-receiving semi-cylindrical bearing surface 86 formed in the second end wall 78, a shaft-receiving aperture 88 formed through the second end wall 78, and portions of each of a plurality of overflow channels 90 formed in each divider wall 80. The shaft-receiving semi-cylindrical bearing surfaces 84, 86 and the shaft-receiving aperture 88 are formed concentrically about the rotation axis 91 of the shaft 48 of the ejector arm 44. The shaft-receiving semi-cylindrical bearing surfaces 84, 86, the shaft-receiving aperture 88 and the portions of the overflow channels 90 are sized to receive the shaft 48 of the ejector arm 44 for free rotation therein. The shaft-receiving semi-cylindrical bearing surfaces 84, 86, the shaft-receiving aperture 88 and the portions of the overflow channels 90 are positioned to permit the longitudinal axis 50 of the shaft 48 of the ejector arm 44 to coincide with the rotation axis 91 when the ejector arm 44 is received in the tray 20 and rotated by the motor 42 and drive train 46.

Each partition or divider wall 80 extends laterally, relative to longitudinal axis 50, across the ice tray 20. In the illustrated embodiment shown in FIG. 7, each divider wall 80 includes a forwardly facing lateral side surface 92, a rearwardly facing lateral side surface 94 and a top surface 96. The forwardly facing lateral side surface 92, rearwardly facing lateral side surface 94 and top surface 96 are formed to include an overflow channel 90. Each overflow channel 90 includes a top wall 98 positioned below the top surface 96 of the divider wall 80. The top wall 98 of the overflow channel 90 is positioned near the desired maximum fill level of each compartment 66. The first end wall 76 includes a rearwardly facing lateral side surface 100. The second end wall 78 includes a forwardly facing lateral side surface 102.

Figure 8:
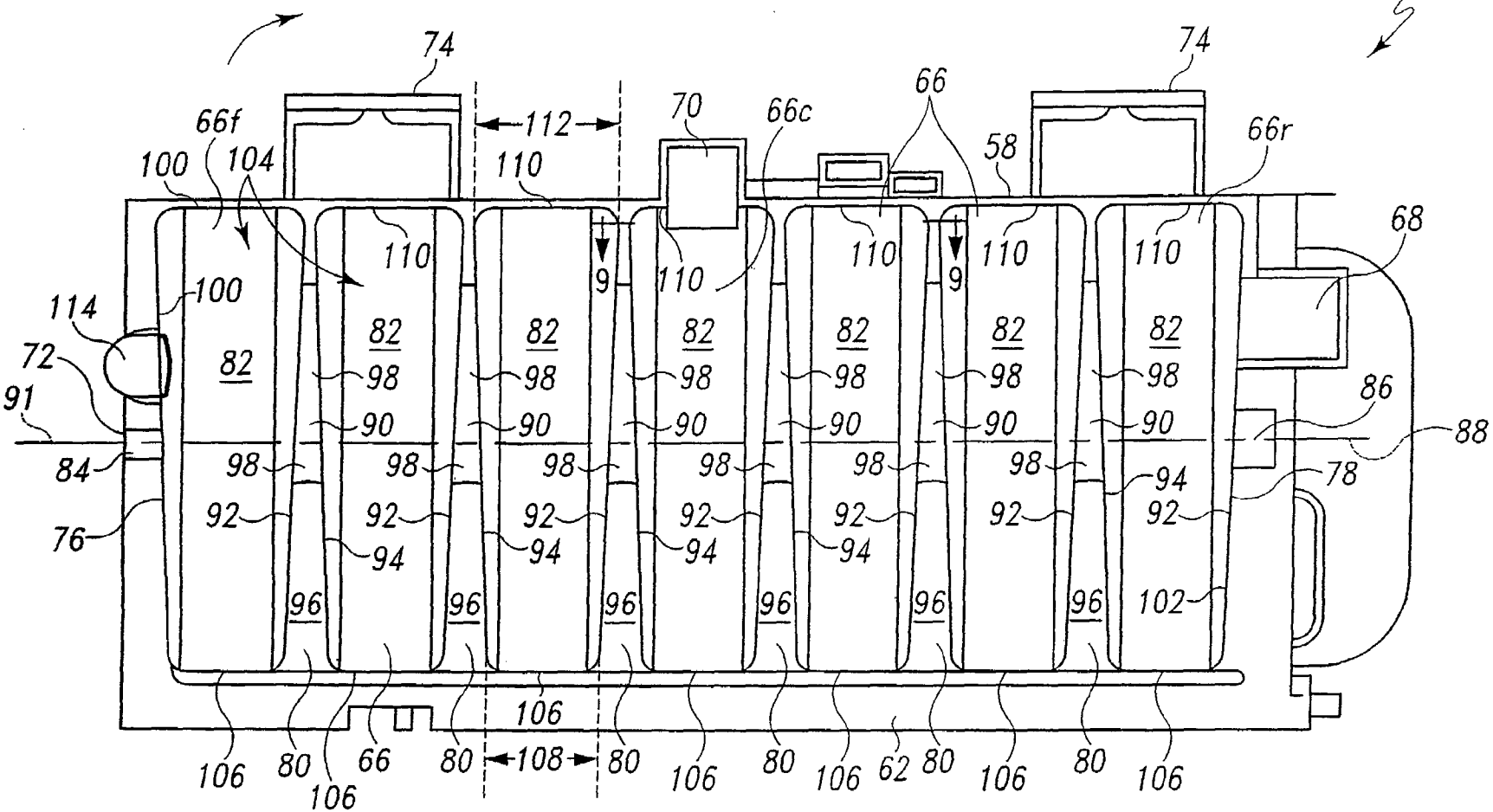
FIG. 8 is a plan view of the ice tray of FIG. 7 showing the configuration of the divider walls between adjacent crescent-shaped compartments.
Figure 9:
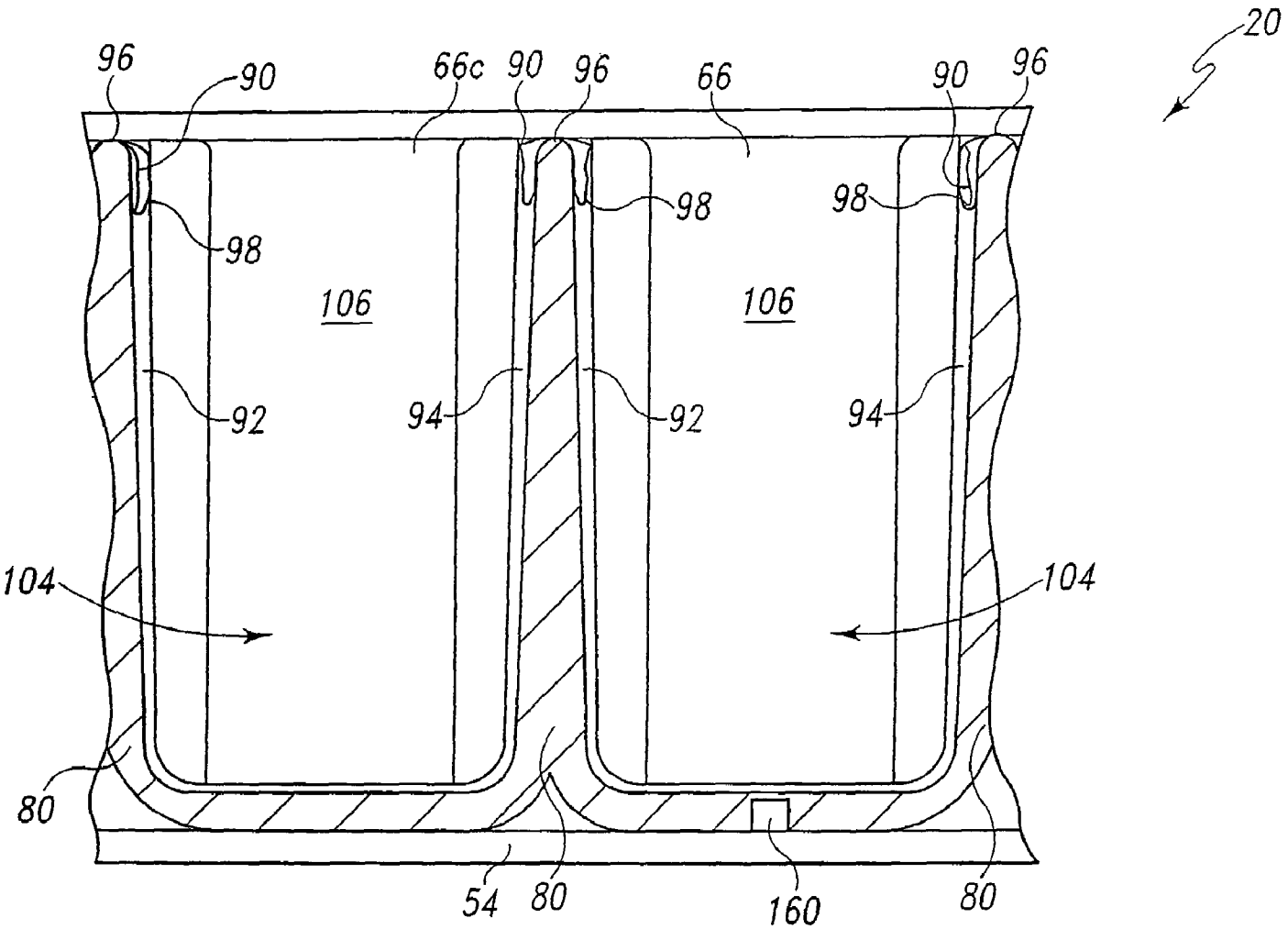
FIG. 9 is a sectional view of the ice tray.

As shown in FIG. 8, for example, each compartment 66 of ice tray 20 is configured to include a space 104 in which a tapered crescent-shaped ice cube is formed. In each compartment 66, one planar lateral side surface 100, 94, from an end wall 76 or a divider wall 80, respectively, is positioned relative to a second planar lateral side surface 92, 102, from an adjacent divider wall 80 or end wall 78, respectively, so that the first planar lateral side surface 100, 94 is spaced apart from the second planar lateral side surface 92, 102 at a downstream or narrow end 106 by a distance 108 relative to an ejection path of movement or harvest direction. In each compartment 66, the first planar lateral side surface 100, 94 is spaced apart from the second planar lateral side surface 92, 102 at an upstream or wide end 110 of the compartment 66 by a distance 112 relative to said ejection path of movement. In the illustrated embodiment, the upstream end 110 of the compartment 66 is the end of the compartment 66 adjacent the ejection side 58 of the tray 20. As shown, for example, in FIG. 8, the distance 112 is greater than the distance 108.

In the illustrated embodiment, each lateral side surface 92, 94, 100, 102 is planar, except for a bottom portion that smoothly curves into the bottom surface 82 to facilitate formation of the ice tray 20 using a molding process. The width of the compartment 66 may be narrower near the bottom and wider near the top to facilitate formation of the ice tray 20 with a molding process. The disclosed ice tray forms tapered crescent-shaped ice cubes which facilitate harvesting of the ice cubes by reducing heating of the tray prior to ejection. Such an ice tray 20 is more particularly described in U.S. patent application Ser. No. 10/895,570, filed Jul. 21, 2004, entitled Method and Device for Producing Ice Having a Harvest-Facilitating Shape, which is assigned to the same assignee as the present invention, the disclosure of which is expressly incorporated by reference in its entirety.

An ice guiding cover 60 (FIG. 4) extends inwardly from the outside 62 of the tray 20 and is configured to include slide fingers 63 with slots 64 formed between them to permit the ejector members 52 of the ejector arm 44 to extend through slots 64 in the cover 60 into the ice tray 20. Ice cubes ejected from ejection side 58 of the tray 20 fall onto the slide fingers 63 of the cover 60 and slide off of the outer edge of the cover 60 into the ice bin 24.

Figure 2:
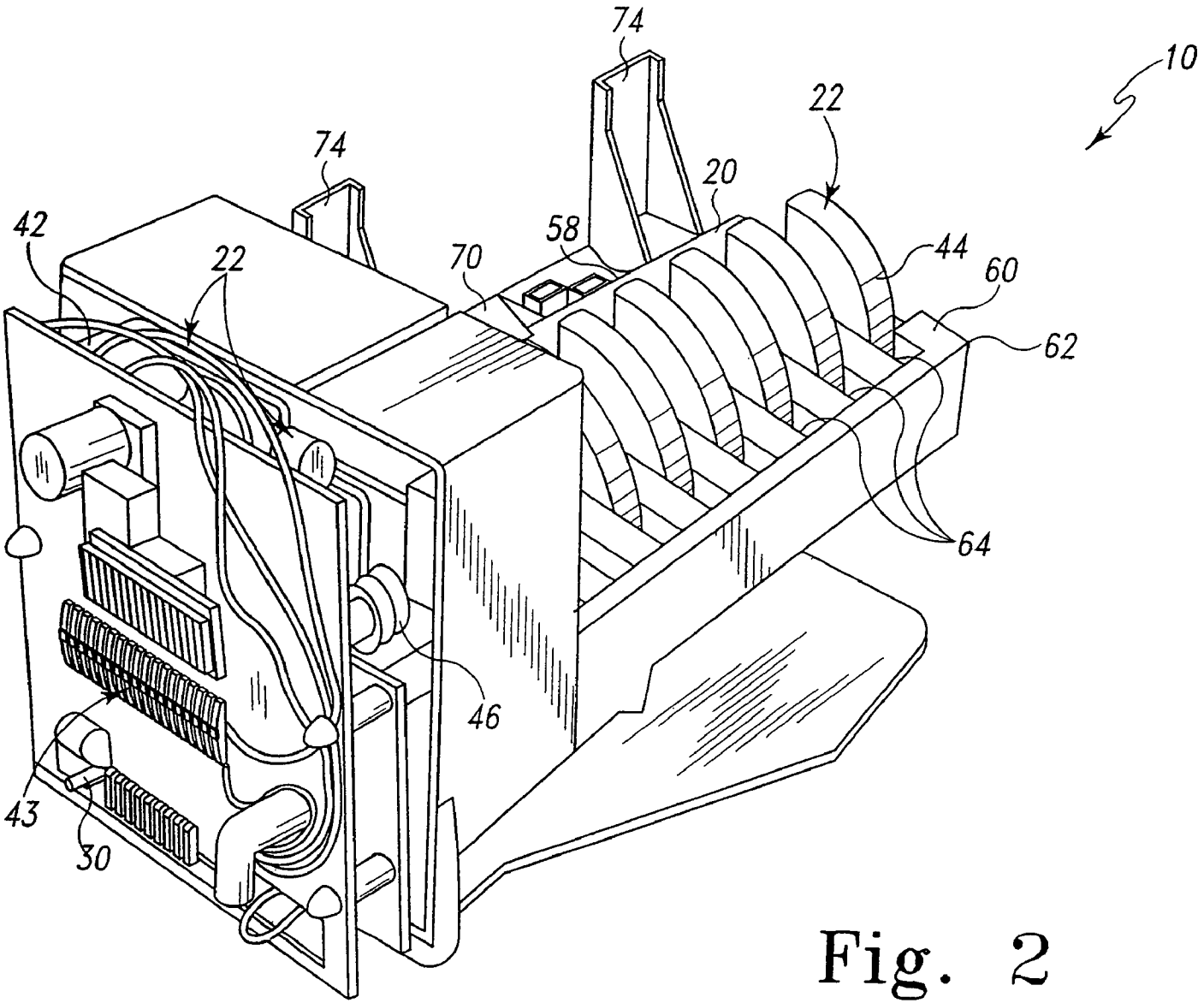
FIG. 2 is a perspective view of the icemaker assembly of FIG. 1 removed from the freezer compartment showing a cover removed from the control box to disclose a controller implemented in part on a PCB and a motor for rotating the ejector arm, the ejector members of which are shown partially inserted into compartments of the ice tray to act as displacement members.
Figure 5:
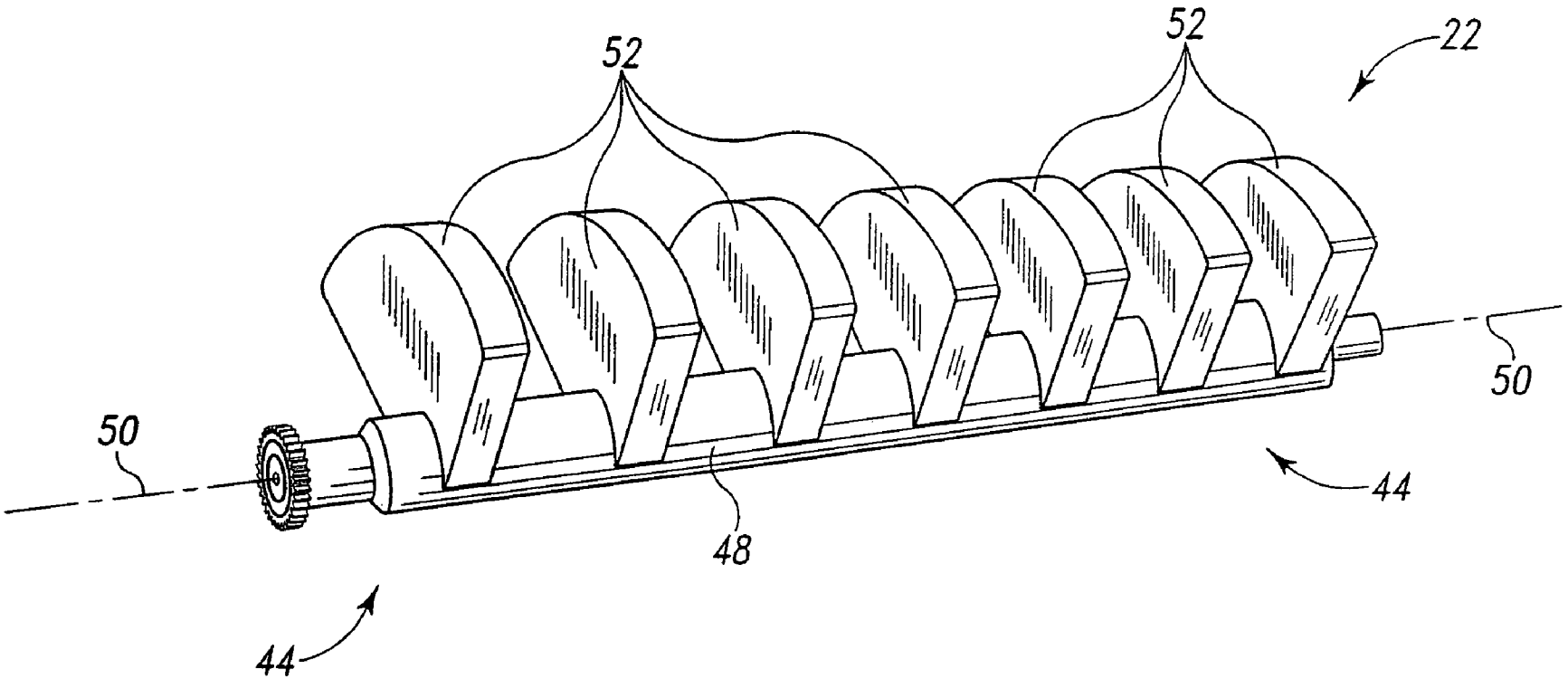
FIG. 5 is a perspective view of the ejector arm of the ice maker assembly of FIG. 2 showing seven ejector members mounted to a shaft configured to be rotated by the motor.

As illustrated in FIG. 2, the ice ejector 22 includes a motor 42 having an output shaft, the ejector arm 44 and a drive train 46 coupling the output shaft of the motor 42 to the ejector arm 44. Rotation of the output shaft of the motor 42 is transferred through the drive train 46 to induce rotation of the ejector arm 44 about its longitudinal axis 50. As shown in FIG. 5, ejector arm 44 includes a shaft 48 formed concentrically about its longitudinal axis 50 and a plurality of ejector members 52 connected to and extending radially beyond the shaft 48. In the illustrated embodiment, the ejector members 52 are crescent-shaped fins and are configured to extend from the shaft 48 into the ice tray 20 when the shaft 48 is rotated. The disclosed ejector members 52 are utilized to eject ice cubes from the tray 20 and may be utilized to displace water in the compartments 66, stir water in the compartments 66 or determine the size of the ice cubes formed in the compartments 66. Those skilled in the art will recognize that ejector members 52 may assume other configurations than those described above and still serve the purpose of acting as an ejector member 52, a displacement member, a stirrer and an ice height detector arm. Ejector members 52 may be fingers, shafts or other structures extending radially beyond the outer walls of shaft 48.

In the illustrated embodiment, motor 42 may be a stepper motor such as a Series LSD42 direct drive, 4 phase bifilar, stepping motor available from Hurst Manufacturing, a part of Emerson Motor Company, St. Louis, Mo. When such a motor 42 is utilized, the controller 30 includes a stepper motor controller configured to control the rotational movement of the motor 42 by energizing the coils to start, stop and reverse the direction of the motor 42. The disclosed stepper motor 42 is supplied with four wires (described in the literature accompanying the Series LSD42 motor as white, blue, red and black) for energizing the coils of the motor 42. The color coding described in the LSD42 motor literature will be utilized in describing the operation of the motor 42 and controller 30, however, those skilled in the art will recognize that more or fewer wires with different color coding may be used to energize the windings of other stepper motors.

The controller 30 induces clockwise rotation by energizing the white and blue wires, white and red wires, black and red wires and black and blue wires in a cyclical fashion. The controller 30 induces counter-clockwise rotation by energizing the black and blue wires, black and red wires, white and red wires and white and blue wires in a cyclical fashion. Stepper motor controller may be implemented on a separate integrated circuit, such as a Model 220001 stepper motor controller available from Hurst Manufacturing or the like. Alternatively, the stepper motor controller may be implemented in the microprocessor or microcontroller of the controller 30 or through separate logic circuitry within the scope of the disclosure.

In FIG. 2, a cover 41 (FIG. 1) is removed from the icemaker assembly 10 to expose a circuit board 43 containing the controller 30. The controller 30 may be implemented, at least in part, by a microcontroller and associated memory. While many microcontrollers, microprocessors, integrated circuits, discrete components and memory devices may be utilized to implement controller 30, the illustrated controller utilizes a 72F324-J685 microcontroller from ST Microelectronics and EEPROM memory available as part number ULN2803A from Toshiba America Electronic Components Inc.

The disclosed microcontroller receives signals from various sensors and components, such as an ejector arm position sensor, a capacitive sensor, and an ice tray temperature sensor, to control various components, such as the motor 42, the heater 54 and the solenoid-operated valve 32 in the water line 28, so that the icemaker assembly 10 operates in the manner described. The controller 30 drives the stepper motor 42 as described above to move the ejector arm 44 and an ice bin bail arm (not shown). The controller 30 also selectively actuates a triac to control the water valve, a triac to control a heater, and a triac to control a cooling fan (not shown). The controller 30 receives feedback from the temperature sensor, a rotary detection emitter and sensor providing position data relating to the ejector arm 44 and an optical sensor (not shown) to detect when the ice bin bail arm (not shown) is extended. The microcontroller also reads data from and writes data to the memory. The memory may store energized winding data, motor direction data, ejector arm position data, fill time data, fill level error data and other information useful to the operation of ice maker assembly 10.

In use, water is released from the water inlet 28 and flows down the end water inlet ramp 68 into the rear compartment **66*r*. During the filling process, a portion of each ejector member 52 may be disposed in the ice forming space 104 of its associated compartment as shown, for example, in FIG. 10. When sufficient water has entered the rear compartment 66*r* to raise the level of the water in the compartment 66*r* to the level of the top surface 98 of the overflow channel 90, water overflows into the adjacent compartment 66 until the adjacent compartment 66 overflows into its adjacent compartment 66. This fill and overflow process continues until water has filled each compartment 66 and the water flow is terminated In another embodiment, motor 42 is a unidirectional synchronous motor such as a permanent magnet synchronous speed gear motor available from Mallory Controls, a Division of Emerson, Indianapolis, Ind. Such a motor has a constant rotor speed proportional to the frequency of the AC power supply. When such a motor is utilized, controller 30 rotates the ejector to submerge the entire ejector member 52 or a portion of the ejector member 52 adjacent the front face 118 or rear face 120 in the compartment 66 to act as displacement members 53 during a filling cycle. In one current embodiment of icemaker assembly 10, a unidirectional motor 42 is stopped during filling to dispose the entire ejector member 52 in the cavity, as shown, for example, in FIG. 10**, to displace water so that a minimum sized ice cube can be formed.

Figure 11:
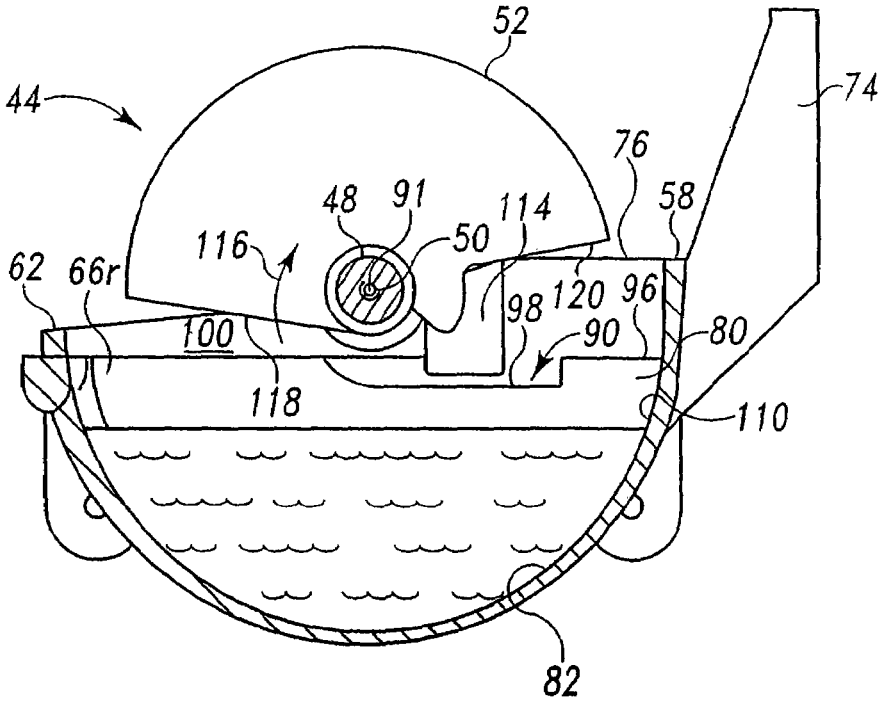
FIG. 11 is a sectional view similar to FIG. 10 following removal of the ejector member from the ice forming space of the compartment and prior to ice forming in the compartment showing how the water level falls below the level of the overflow channel to eliminate formation of an ice bridge between adjacent cubes.
Figure 12:
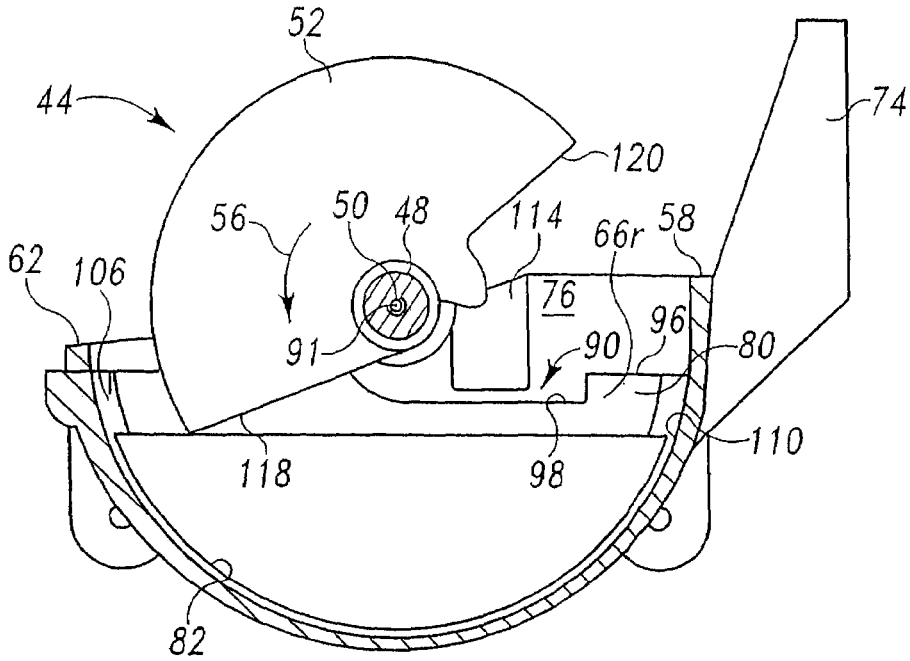
FIG. 12 is a sectional view similar to FIG. 10 after ice has formed in the compartment and the ejector arm has been rotated to bring the front face of the ejector member into contact with the top surface of the ice cube formed accurately representing either the ejector arm touching off on the ice cube to determine its size or the ejector arm initiating an ejection cycle.
Figure 13:
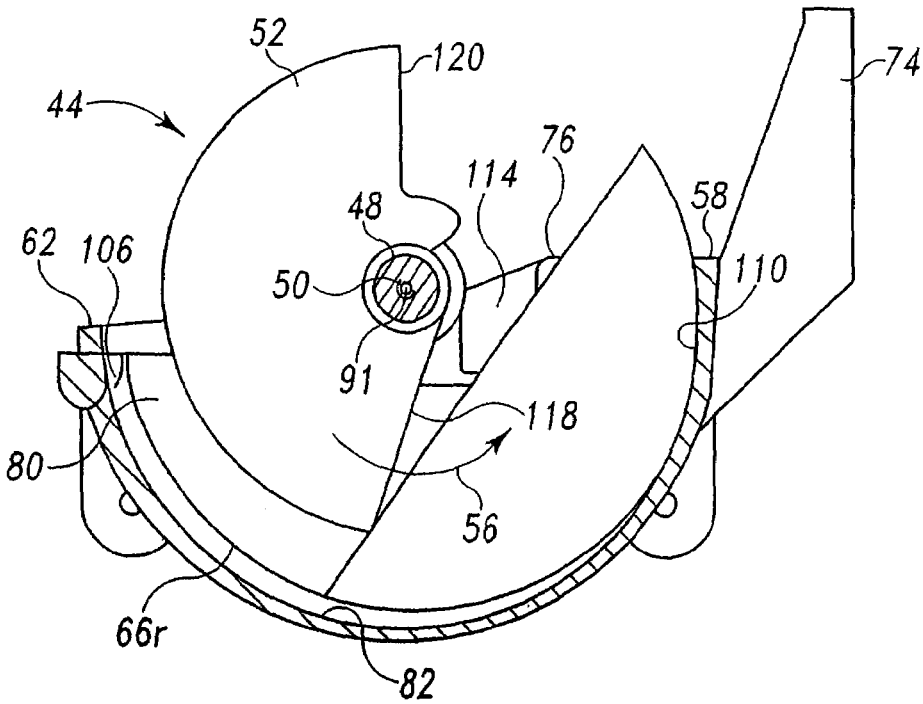
FIG. 13 is a section view similar to FIG. 10 after the ejector arm has rotated partially in to the ice forming space to urge the ice cube formed in the compartment along an ejector path of motion.

The controller 30 controls the motor 42 to position a portion of the displacement member 53 in the ice forming compartment 66 at some time during the filling operation. Prior to freezing, the controller 30 again drives the motor 42 so that rotation of the ejector arm 44 is stopped with the ejector members 52 disposed completely outside the ice forming space 104 of each compartment 66 for a period of time to permit water to freeze in the ice tray 20 (FIG. 11). Once the water is frozen in the ice tray 20, controller 30 enables motor 42 to drive the ejector arm 44 in the direction of arrow 56, as shown in FIGS. 3, 4, 12 and 13, to force ice in the tray 20 out of the ejection side 58 of the tray 20. In the illustrated embodiment, ejection side 58 of the tray 20 is the side of the tray 20 adjacent the side wall 16 of the freezer compartment 12 to which the icemaker assembly 10 is mounted.

In FIGS. 3, 6, 7, and 8, a fill level reservoir 114 is shown as being formed in the first end wall 76 of the front compartment 66*f*. Water flows into the fill level reservoir 114 when each compartment 66 is filled to the desired level. A sensor 200 (FIG. 14) is mounted in the fill level reservoir 114 to sense the presence of water and to send a signal to the controller 30 to stop the filling operation. Cessation of the filling operation may be accomplished in various ways, however, the illustrated icemaker assembly 10 closes a solenoid valve positioned between the water source and the water inlet 28 to stop the filling operation.

Figure 10:
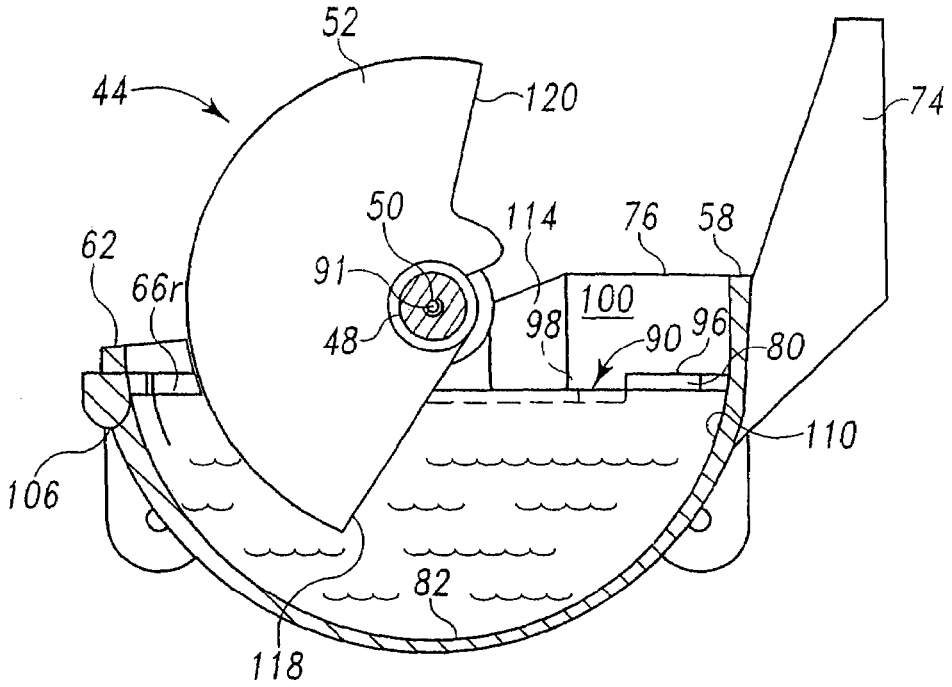
FIG. 10 is a sectional view of the ice tray and ejector arm taken through the rear compartment adjacent the rear end wall looking forward toward the front end wall during the fill operation showing the ejector arm positioned with an ejector member extending into the ice forming space of the compartment to act as a displacement member ofr displacing water that is flowing over the overflow channel.

In the illustrated embodiment, following the previous ice ejection operation, the ejection arm 44 is rotated so that a portion of the ejection member 52 adjacent the front face 118 of the ejection member 52 is disposed in each compartment 66, as shown, for example, in FIG. 10. This portion of the ejection member 52 displaces water in the compartment 66 inducing overflow of the water prior to there being a sufficient volume of water to alone cause overflow of the compartment 66. Once the sensor 200 in fill level reservoir 114 senses the presence of water, the flow of water into the ice tray 20 is stopped. At some time prior to the water freezing in each compartment 66, the ejector arm 44 is turned in the direction of arrow 116 in FIG. 11 until the entire ejection member 52 is disposed outside of the ice forming space 104 in each compartment 66, as shown, for example, in FIG. 11. It is within the scope of the disclosure for the rotation of the ejector arm 44 to be stopped following ejection of the ice cubes 130 from the compartments 66 so that a portion of the ejector member 52 adjacent the rear face 120 of the ejector member 52 is left disposed in the ice forming space of each compartment 66 to displace water during the next filling operation.

Figure 14:
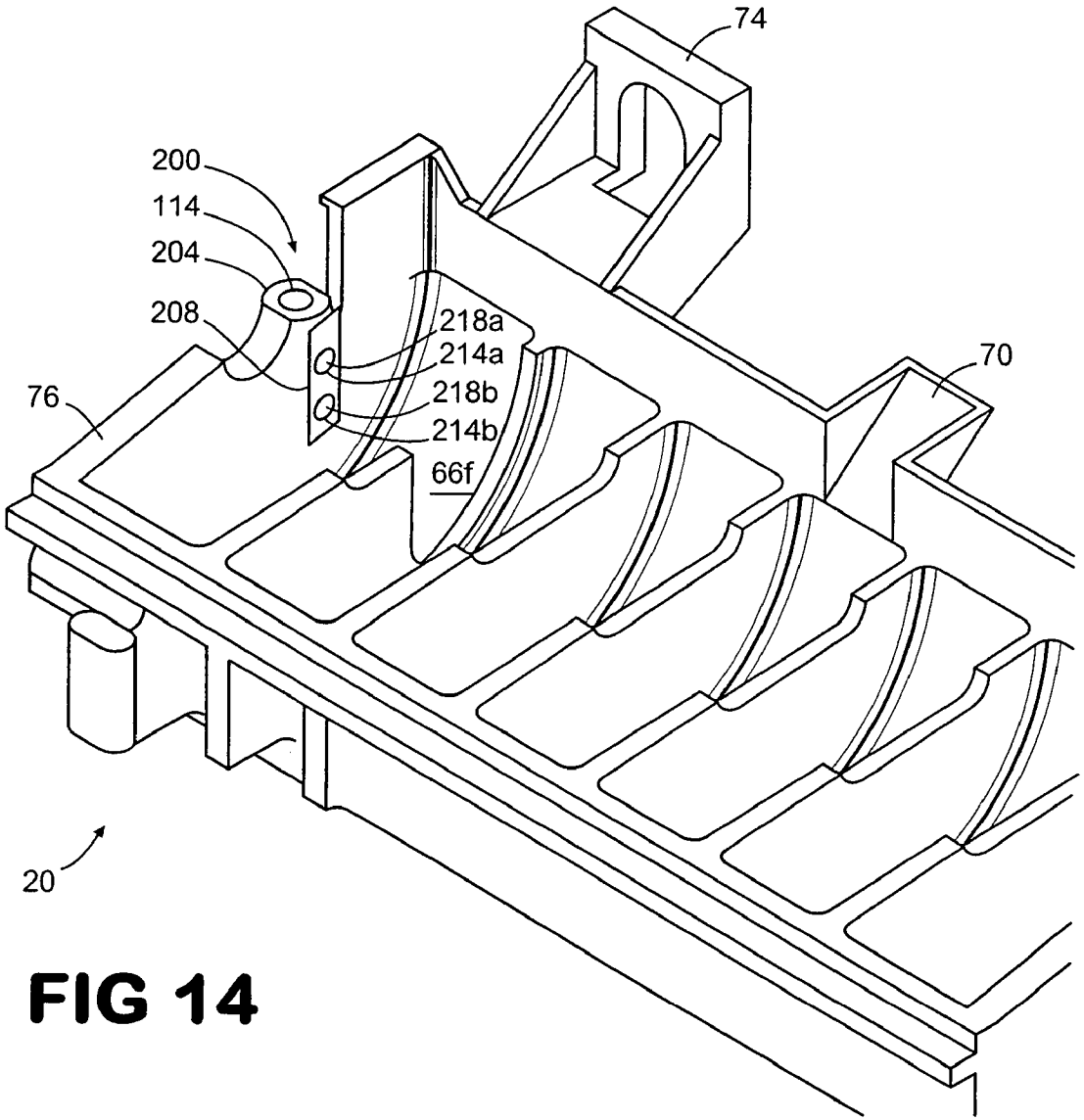
FIG. 14 is a perspective view of the ice tray housing a capacitive sensor for determining the water level in the last compartment to be filled with water.
Figure 15:
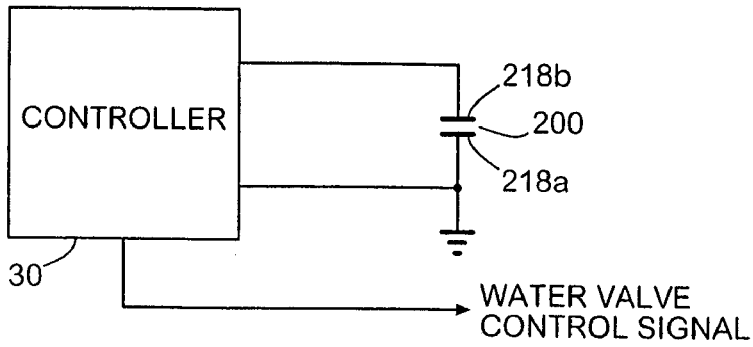
FIG. 15 is an electrical diagram of the coupling between a water valve controller and the capacitive sensor of FIG. 14.

In accordance with the principles of the present invention, the controller opens and closes the water valve in accordance with a signal generated by a capacitive sensor in response to the water level in a compartment of an ice tray. As shown in FIG. 14, a water control system for an ice maker includes a capacitive sensor 200 located within a compartment 66 of an ice tray 20 in an ice maker 10. Preferably, the sensor 200 is mounted in the fill level reservoir 114 formed in wall 76 of the compartment 66*f* of the ice tray 20 because it is the last compartment filled during the water fill cycle. The capacitive sensor 200 generates a water fill signal corresponding to dielectric changes in the sensor 200 caused by the level of the water within the compartment 66*f* of the ice tray 20. The controller 30 generates a water valve control signal in response to the water fill signal received from the capacitive sensor 200 (FIG. 15).

The capacitive sensor 200 may be housed, for example, in a semi-cylindrical housing 204 that frictionally fits within fill level reservoir 114. The housing 204 is formed from an electrically insulating material. The flat wall 208 of housing 204 is generally flush with wall 76 of the ice tray 20. Mounted within two openings 214*a*, 214*b* in the wall 208 are two electrodes 218*a*, 218*b*, respectively, that are electrically isolated from one another and from the ice tray. The electrodes 218*a* and 218*b* are exposed to water filling the compartment in the ice tray. The electrodes 218*a* and 218*b* are electrically coupled by wires to the controller 30 to provide the controller 30 with the water fill signal that corresponds to the water level in the compartment 66*f*.

Figure 16:
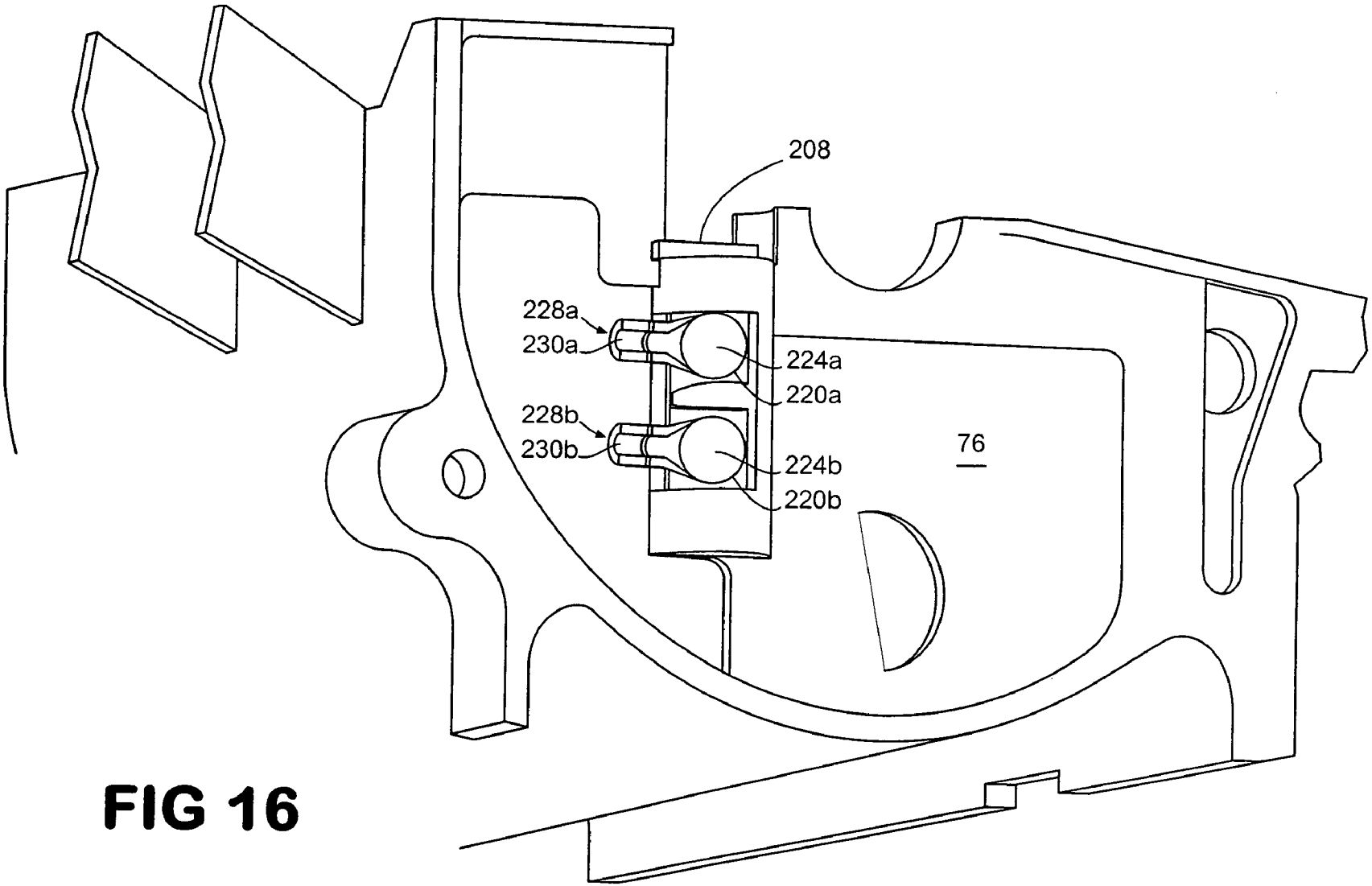
FIG. 16 is a perspective view of the outside of the end wall in which the capacitive sensor is mounted showing the electrical connectors for coupling the capacitive sensor to the water valve controller.

As shown in FIG. 16, two holes 220*a* and 220*b* in the end wall 76 enable the spherical connectors 224*a* and 224*b* of the wire lugs 228*a* and 228*b* to contact the electrodes 218*a* and 218*b* to establish electrical connection with the electrodes. Exposed conductors from insulated wire may then be soldered in the wire receptacles 230*a* and 230*b* for coupling of the signal from the sensor 200 to the controller 30. The sensor 200 may be any known capacitive sensor that is appropriately sized to fit the structure in the ice tray for the sensor. However, a structure that exposes two electrodes to the water level in the compartment 66*f* while electrically isolating the electrodes from one another and the ice tray 20 may be used to sense the dielectric changes in the compartment as water rises in the compartment.

Although the capacitive sensor 200 is shown as being implemented with two electrodes mounted in a semi-cylindrical housing and installed in the fill level reservoir 114 of the ice tray 20, other mounting arrangements are possible. For example, other embodiments of capacitive sensors may be attached to the ice tray 20 with adhesives or other types of mechanical and chemical couplers to expose electrodes forming a capacitor in the compartment 66*f*. Preferably, the electrodes are located so the lower electrode is at a position corresponding to the desired top for water filling the compartment. Additionally, the two electrodes should be spaced at a distance that enables them to form a capacitor, while also providing a margin of separation that enables the residual water to fill the compartment without shorting the two electrodes to one another.

The electrodes 218*a* and 218*b* form the plates of a capacitor in the sensor 200 as shown schematically in FIG. 15. The two electrodes 218*a* and 218*b* are preferably arranged in a substantially vertical configuration with reference to a top and a bottom of the compartment 66 so that water filling the compartment submerges one electrode before contacting the second electrode. When the dielectric between the plates is air, as when the compartment 66 is empty, the capacitance of the sensor is a smaller value than when the lower electrode 218*b* contacts water filling the compartment 66. Because water has a dielectric value that is approximately eighty (80) times greater than air, the capacitance of the sensor 200 significantly increases when water contacts the lower electrode 218*b*. This increase results in a change in the water fill signal generated by the sensor 200 that indicates to the controller 30 that the water level has reached the lower electrode in the compartment 66*f*. If the water continues to rise in the compartment 66*f* to the place where water contacts the upper electrode 218*a*, the water electrically couples the electrodes 218*a* and 218*b* to one another.

In response to the capacitive sensor 200 indicating an increase in the dielectric of the sensor 200, the controller 30 generates a water valve control signal that shuts the valve to terminate water flow into the ice tray 20. Residual water in the fill line and spout continues to flow into the compartment, but no further flow from the water supply occurs. The controller 30 includes a timer for timing a period from the controller 30 generating a water valve control signal that opens the water valve to the controller receiving a signal from the capacitive sensor 200 that indicates an increase in the dielectric of the capacitive sensor. A flow rate meter 230 in the controller 30 measures a flow rate of water filling the compartment with reference to the timed period. The flow meter 230 may be implemented in software executed by the controller 30. The software uses a volumetric parameter that corresponds to the volume of the preceding compartments 66 that were filled before the compartment 66 in which the sensor 200 is placed was filled plus the volume formed by a line around the inside perimeter of the compartment 66*f* at the lower electrode 218*b* to the bottom of the compartment 66*f*. This volumetric parameter is divided by the time period measured from the opening of the water valve to the change in the water fill signal generated by the sensor 200 in response to the rising water to determine the water flow rate.

The controller 30 also includes a dielectric differential rate meter for measuring a rate of change in the water fill signal received from the capacitive sensor 200. The change in this signal corresponds to displacement of the air between the electrodes 218*a* and 218*b* by the water rising between the electrodes. A water hardness meter 234 implemented in the controller 30 measures the mineral hardness of the water filling the compartment. The water hardness meter is implemented in software and uses the measured flow rate and the dielectric differential rate to determine the mineral hardness.

Figure 17:
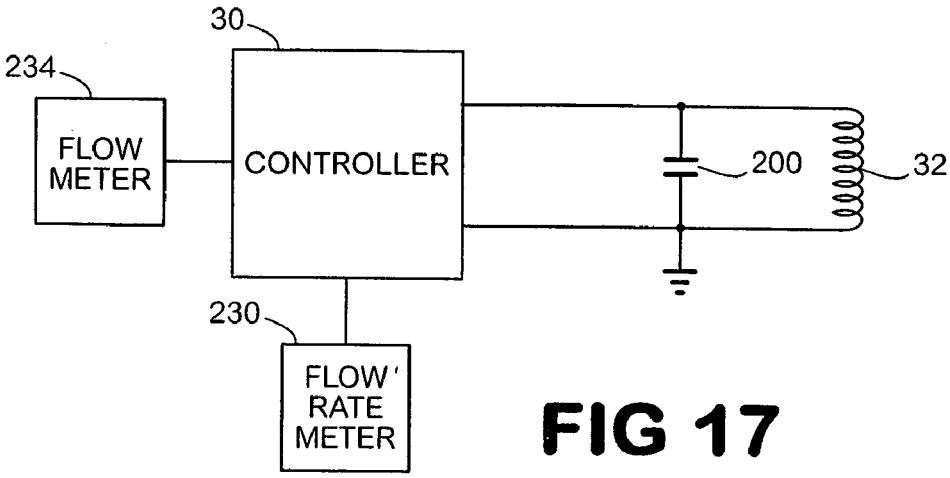
FIG. 17 is an electrical diagram of the coupling between a water valve controller, the capacitive sensor of FIG. 14, and a solenoid-controlled water valve.

The capacitive sensor 200 may be placed in the control circuit for the water valve as shown in FIG. 17 so it shunts the water valve control signal in response to water in the compartment contacting both electrodes in the compartment. If a solenoid-controlled valve is used to control water flow into the ice tray 20 and the capacitive sensor 200 is electrically coupled across the solenoid-controlled valve, the sensor 200 may be used as a backup control device for shutting off water flow to the ice tray 20. As noted above, water contacting both electrodes 218*a* and 218*b* electrically couples the electrodes together. If the water valve control signal is coupled to the sensor 200 as shown in FIG. 17, the signal is shunted to ground when water contacts both electrodes rather than flowing through the relay to energize the valve opening. By shunting the current through the shorted sensor, the water valve is shut off without requiring a control action by the controller 30. Thus, the electrical arrangement shown in FIG. 17 provides a backup to the regulation of the water fill valve by the controller 30.

The capacitive sensor 200 used in the water control system of the present invention, is preferably mounted in the last compartment 66*f* of the ice tray 20 that is filled with water during a water fill cycle. Additionally, the lower electrode is preferably mounted at a position so that water contacting the lower electrode causes the water fill signal to identify an increase in the dielectric level. This enables the signal generated by the sensor to indicate that the ice tray 20 is substantially full. The controller 30, in response, may generate a water valve control signal that shuts the water valve so that water no longer flows through the inlet 28 into the ice tray 20. However, residual water in the inlet continues to flow into the ice tray 20. If the water valve is a solenoid-controlled valve and the capacitive sensor is electrically coupled across the solenoid as discussed above, the water valve is closed by the shunting of the water valve control signal through the capacitive sensor when both of its electrodes are submerged. Thus, if the controller 30 does not detect the change in dielectric and does not shut the water valve, the capacitive sensor 200 provides a water valve shutoff backup.

Figure 18:
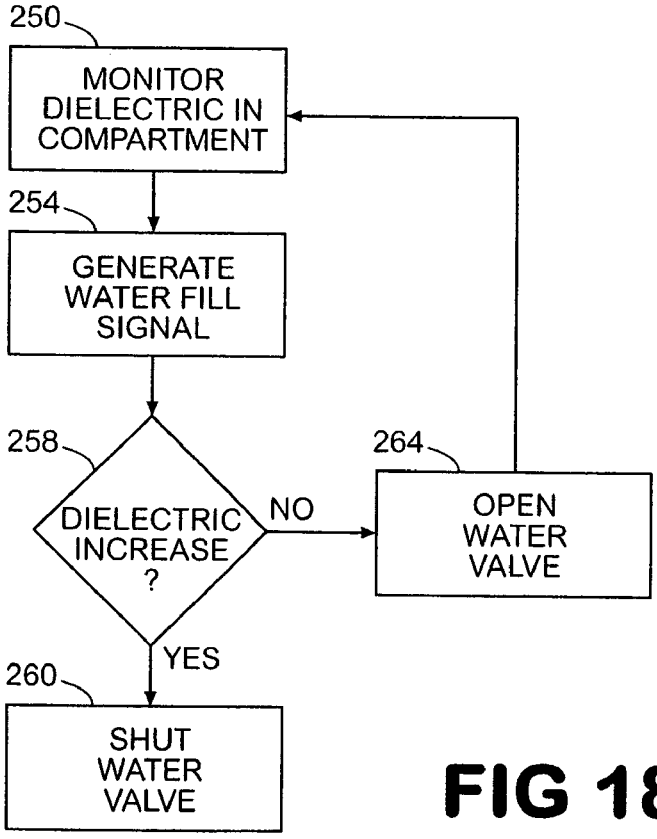
FIG. 18 is a flow diagram of a method incorporating the principles of the present invention.

A method for controlling water flow into an ice maker is shown in FIG. 18. The method includes generating a water fill signal corresponding to a dielectric change in a capacitive sensor located in a compartment of an ice tray and generating a water valve control signal for opening and closing a water valve in response to the water fill signal. As shown in FIG. 18, the method includes monitoring the dielectric between electrodes in a compartment of the ice tray 20 (block 250) and generating a water fill signal corresponding to the monitored dielectric (block 254). If the dielectric increased (block 258), a water valve control signal is generated that shuts the water valve (block 260). Otherwise, a water valve control signal is generated that opens the water valve (block 264). The dielectric increase signal generated by the electrodes arranged in the ice tray compartment is in response to the submersion of the electrode that is lower than the other electrode.

The method of the present invention may also compute process parameters from data obtained from the sensor 200. To obtain water flow, a period is timed from the commencement of water flowing into the ice tray until the generation of the dielectric increase signal. This time period and the volume of the water delivered to the ice tray may be used to measure a flow rate during the timed period. A mineral hardness parameter may also be determined by measuring a rate of change in the dielectric increase signal. The mineral hardness of the water filling the ice tray may be computed using the measured flow rate and the rate of change in the dielectric increase signal.

Backup control for the water valve is provided by shunting the water valve control signal to electrical ground in response to water in the compartment contacting both electrodes in the compartment. When a water valve control signal is coupled to a solenoid-controlled valve to control water flow into the ice tray 20, shunting the water valve control signal through the two electrodes to close the water valve in response to the increase dielectric signal provides a backup control that helps prevent water overflow in the ice tray.

A method for incorporating a water control system in an ice maker includes installing two electrodes in a compartment of an ice tray, electrically isolating the two electrodes from one another and the ice tray so the two electrodes are exposed to water filling the compartment 66, and coupling the electrodes to a controller (block 278). The electrodes are preferably arranged so they are substantially aligned vertically with reference to a top and a bottom of the compartment.

Although specific embodiments of the invention have been described herein, other embodiments may be perceived by those skilled in the art without departing from the scope of the invention as defined by the following claims.

What is claimed is:

1. A water control system for an ice maker comprising:

a capacitive sensor located within a compartment of an ice tray in an ice maker, the capacitive sensor generating a water fill signal corresponding to dielectric changes in the sensor as water fills the compartment of the ice tray; and a controller for generating a water valve control signal in response to the water fill signal received from the capacitive sensor.

2. The system of claim 1, the capacitive sensor further comprising:

two electrodes that are electrically isolated from one another and from the ice tray, both electrodes being exposed to water filling the compartment in the ice tray.

3. The system of claim 2 wherein the two electrodes are arranged in a substantially vertical configuration with reference to a top and a bottom of the compartment so that water filling the compartment submerges one electrode before contacting the second electrode.

4. The system of claim 1 wherein the controller generates a water valve control signal that shuts the valve in response to the capacitive sensor indicating an increase in the dielectric of the capacitive sensor.

5. The system of claim 1, the controller further comprising:

a timer for timing a period from the controller generating a water valve control signal that opens the water valve to the controller receiving a signal from the capacitive sensor that indicates an increase in the dielectric of the capacitive sensor; and a flow rate meter for measuring a flow rate of water filling the compartment with reference to the timed period.

6. The system of claim 5, the controller further comprising:

a dielectric differential rate meter for measuring a rate of change in the water fill signal received from the capacitive sensor; and a water hardness meter for measuring a mineral hardness of the water filling the compartment, the water hardness meter using the measured flow rate and the dielectric differential rate for measuring the mineral hardness.

7. The system of claim 4, the capacitive sensor shunting the water valve control signal in response to water in the compartment contacting both electrodes in the compartment.

8. The system of claim 1 further comprising:

a solenoid-controlled valve for controlling water flow into the compartment, the solenoid-controlled valve being coupled to the controller to receive the water valve control signal; and the capacitive sensor being electrically coupled across the solenoid-controlled valve so that the capacitive sensor shunts the water valve control signal in response to water in the compartment contacting both electrodes in the compartment.

9. A method for controlling water flow into an ice maker comprising:

generating a water fill signal corresponding to a dielectric change in a capacitive sensor located in a compartment of an ice tray; and generating a water valve control signal for opening and closing a water valve in response to the water fill signal.

10. The method of claim 9 further comprising:

electrically isolating two electrodes from one another and the ice tray; and the water fill signal generation corresponding to the dielectric change resulting from water filling the compartment contacting the electrodes.

11. The method of claim 10 further comprising:

arranging the electrodes in substantially a vertical configuration with reference to a top and a bottom of the compartment; and generating a dielectric increase signal in response to the submersion of the electrode that is lower than the other electrode.

12. The method of claim 11 further comprising:

generating a water valve control signal that shuts the water fill valve in response to the dielectric increase signal.

13. The method of claim 12 further comprising:

timing a period that commences as water flows into the compartment of the ice tray and ends in response to the dielectric increase signal; and measuring a flow rate with reference to the timed period.

14. The method of claim 13 further comprising:

measuring a rate of change in the dielectric increase signal; and measuring a mineral hardness of the water filling the compartment, the mineral hardness being measured with reference to the measured flow rate and the rate of change in the dielectric increase signal.

15. The method of claim 14 further comprising:

shunting the water valve control signal in response to water in the compartment contacting both electrodes in the compartment.

16. The method of claim 15 further comprising:

controlling a solenoid-controlled valve with the water valve control signal; and shunting the water valve control signal through the two electrodes to close the water valve in response to the increase dielectric signal.

* * * * *